US007336564B2

(12) United States Patent
Feodoroff

(10) Patent No.: US 7,336,564 B2
(45) Date of Patent: Feb. 26, 2008

(54) BLISTER PACK MEDICATION REMINDER SYSTEM AND METHOD

(76) Inventor: Thomas J. Feodoroff, 216 Citadel Meadow Bay N.W., Calgary, Alberta (CA) T3G 4Z4

( * ) Notice: Subject to any disclaimer, the term of this patent is extended or adjusted under 35 U.S.C. 154(b) by 634 days.

(21) Appl. No.: 10/979,689

(22) Filed: Nov. 1, 2004

(65) Prior Publication Data

US 2006/0021900 A1 Feb. 2, 2006

(30) Foreign Application Priority Data

Jul. 28, 2004 (CA) ..... 2475809

(51) Int. Cl.
*G04B 47/00* (2006.01)
*B65D 83/04* (2006.01)

(52) U.S. Cl. ..... 368/10; 206/534

(58) Field of Classification Search ..... 206/530, 206/531, 534, 459.1, 539, 807; 116/308; 368/10, 107
See application file for complete search history.

(56) References Cited

U.S. PATENT DOCUMENTS 4,526,474 A * 7/1985 Simon ..... 368/10
4,617,557 A * 10/1986 Gordon ..... 340/309.7
4,660,991 A * 4/1987 Simon ..... 368/10
4,858,207 A * 8/1989 Buchner ..... 368/10
5,181,189 A * 1/1993 Hafner ..... 368/10
6,411,567 B1 * 6/2002 Niemiec et al. ..... 368/10
7,126,879 B2 * 10/2006 Snyder ..... 368/10
2005/0226100 A1 * 10/2005 Simon et al. ..... 368/10
2006/0144747 A1 * 7/2006 Le et al. ..... 206/531

* cited by examiner

*Primary Examiner*—David T. Fidei

(57) ABSTRACT

The present invention is a medication reminder system and method for use with blister packs containing medications to be taken by a patient wherein the system alerts the patient when to take the medication contained in a particular blister. An audible alarm and a light indicate which blister is to be opened to remove the medication. The system comprises a case large enough to enclose a blister pack and has top and bottom halves that are releasably connected together. A circuit board comprising the electronics that operate the system is placed on top of the blister pack and is enclosed in the case along with the blister pack. Both the circuit board and the top case half have openings that allow the blisters of the pack to pass through. Openings on the bottom case half permit the medications in the blisters to be removed. The circuit board is programmable to set the time of an internal clock and to set up to four alarms a day when medications are to be taken. The alarms consist of an audible alarm along with a light flashing by the blister to be expressed by the patient. When the blister pack is depleted, it can be replaced with a new pack without reprogramming the alarm times unless the patient's medical regimen has changed requiring medication to be taken at different times.

12 Claims, 11 Drawing Sheets

FIG. 3 Set Time Main Program
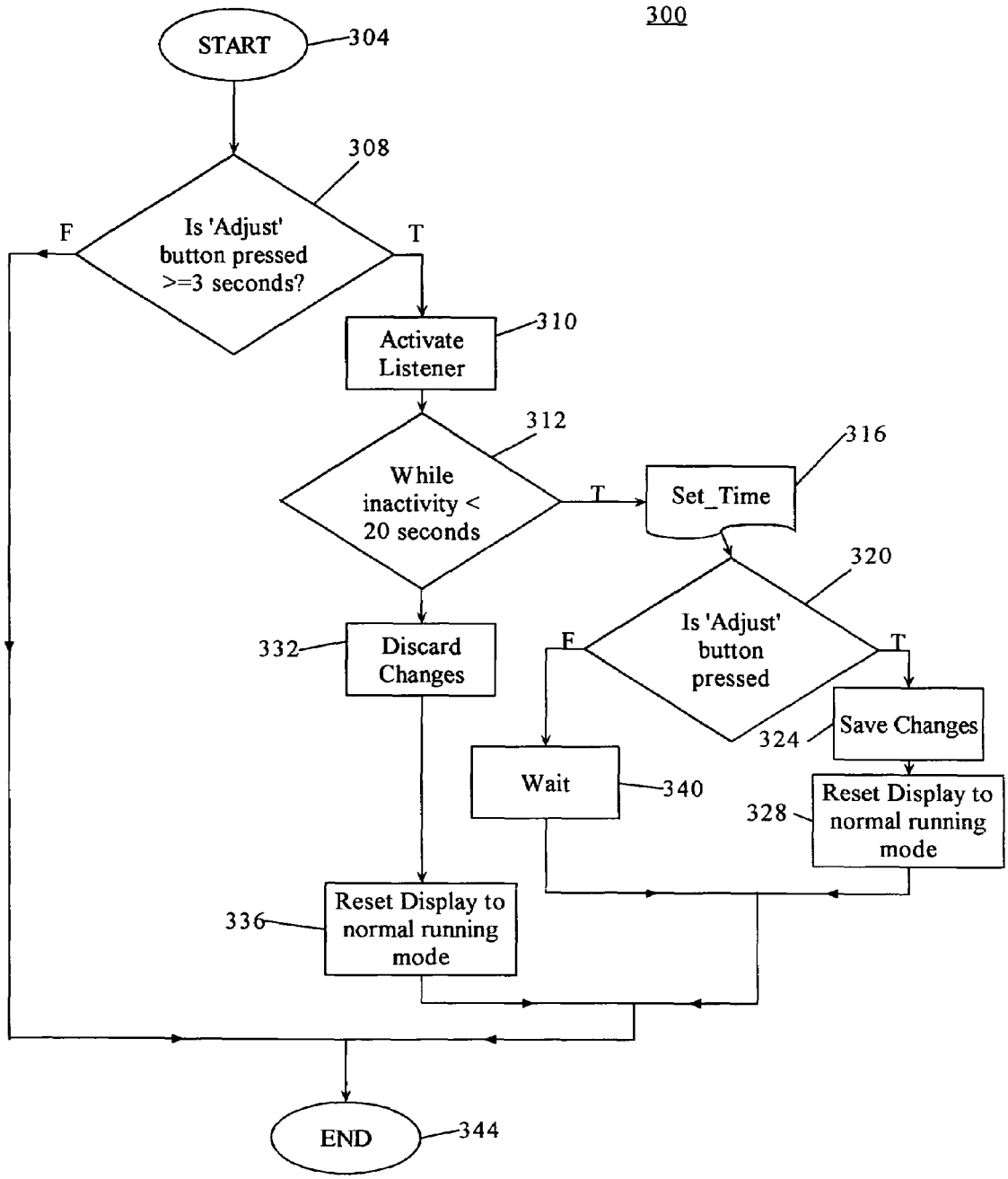

FIG. 4 Set Time Sub-Procedure
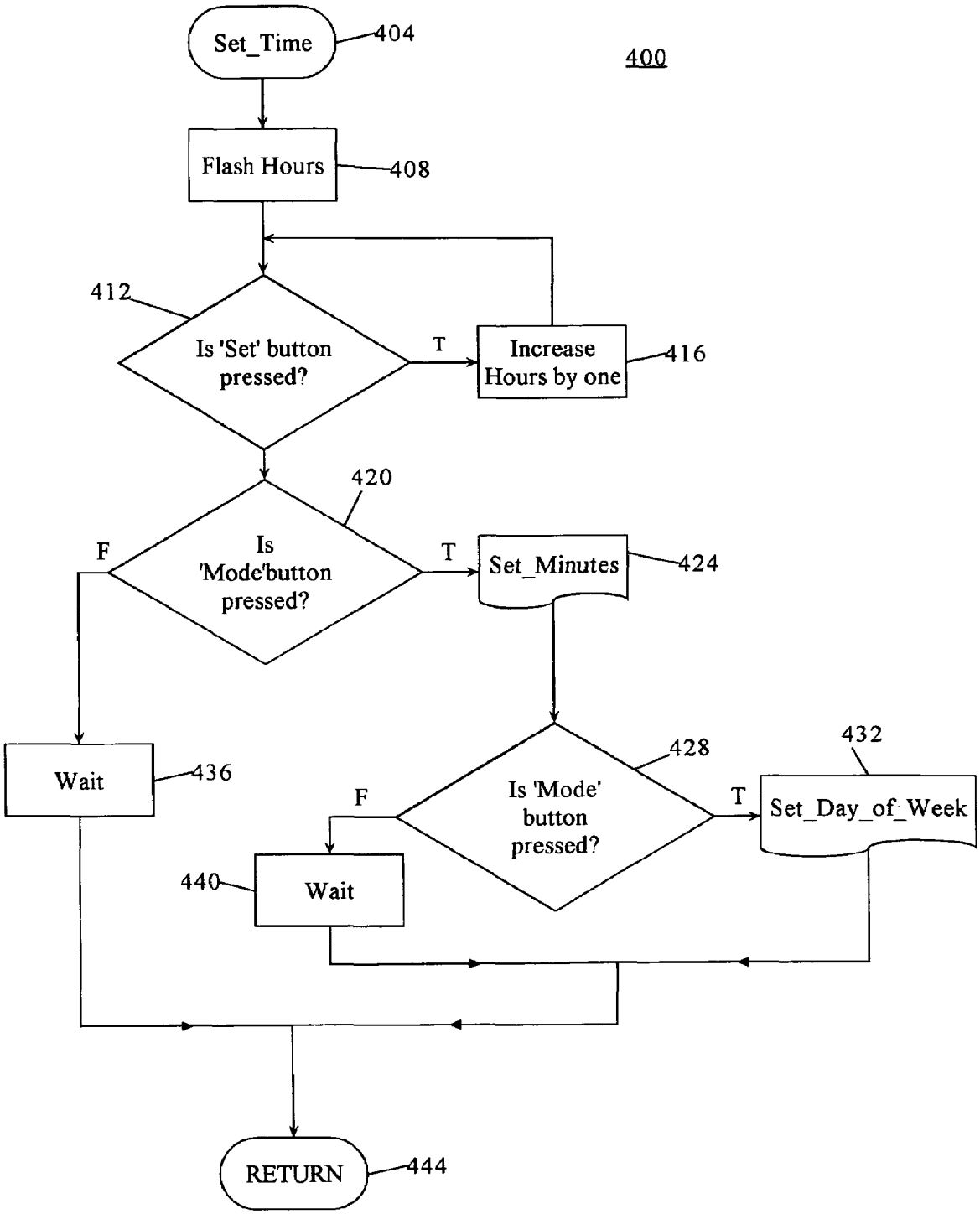

FIG. 5 Set Minutes Sub-Procedure
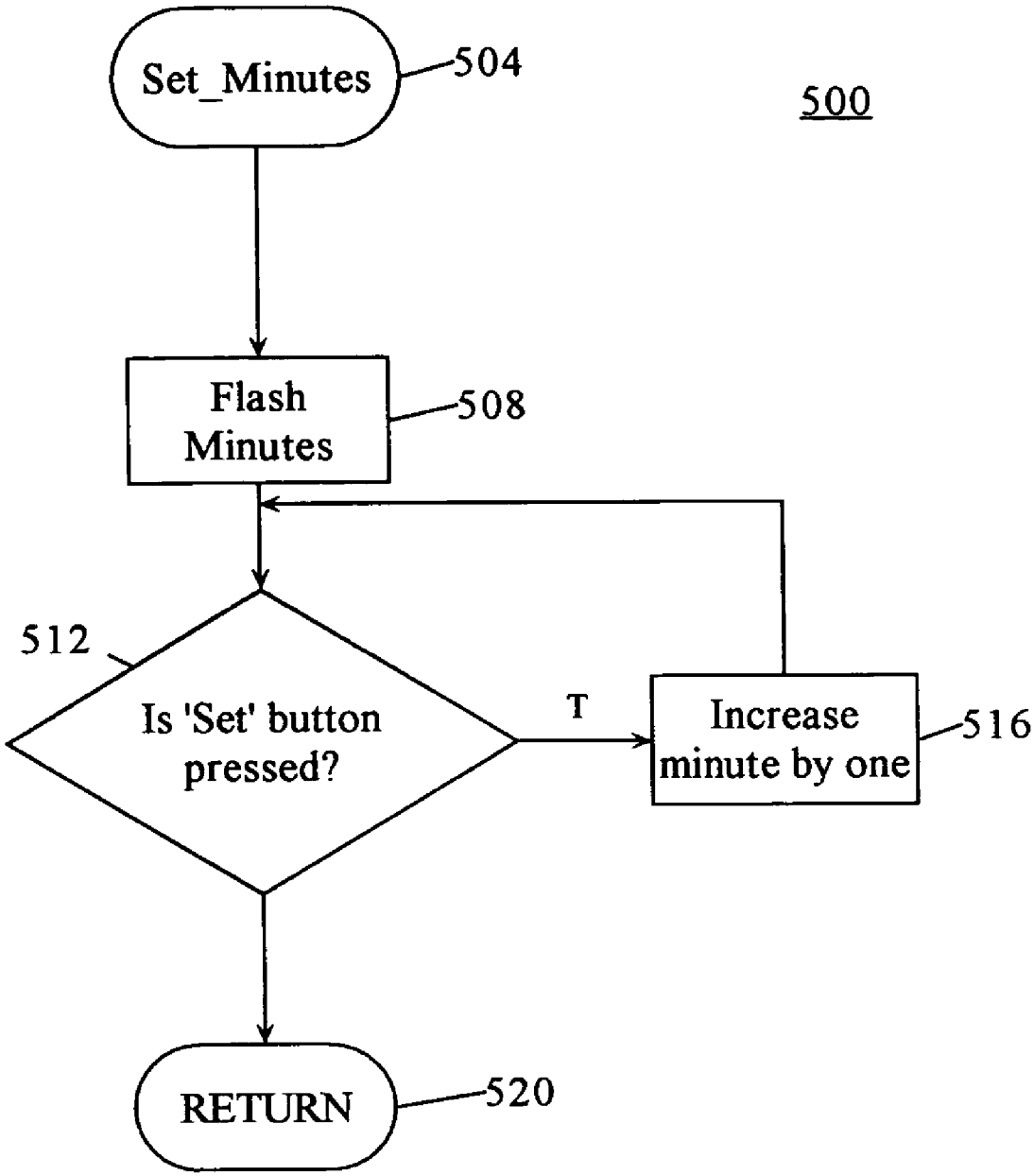

FIG. 6 Set Day of Week Sub-Procudure
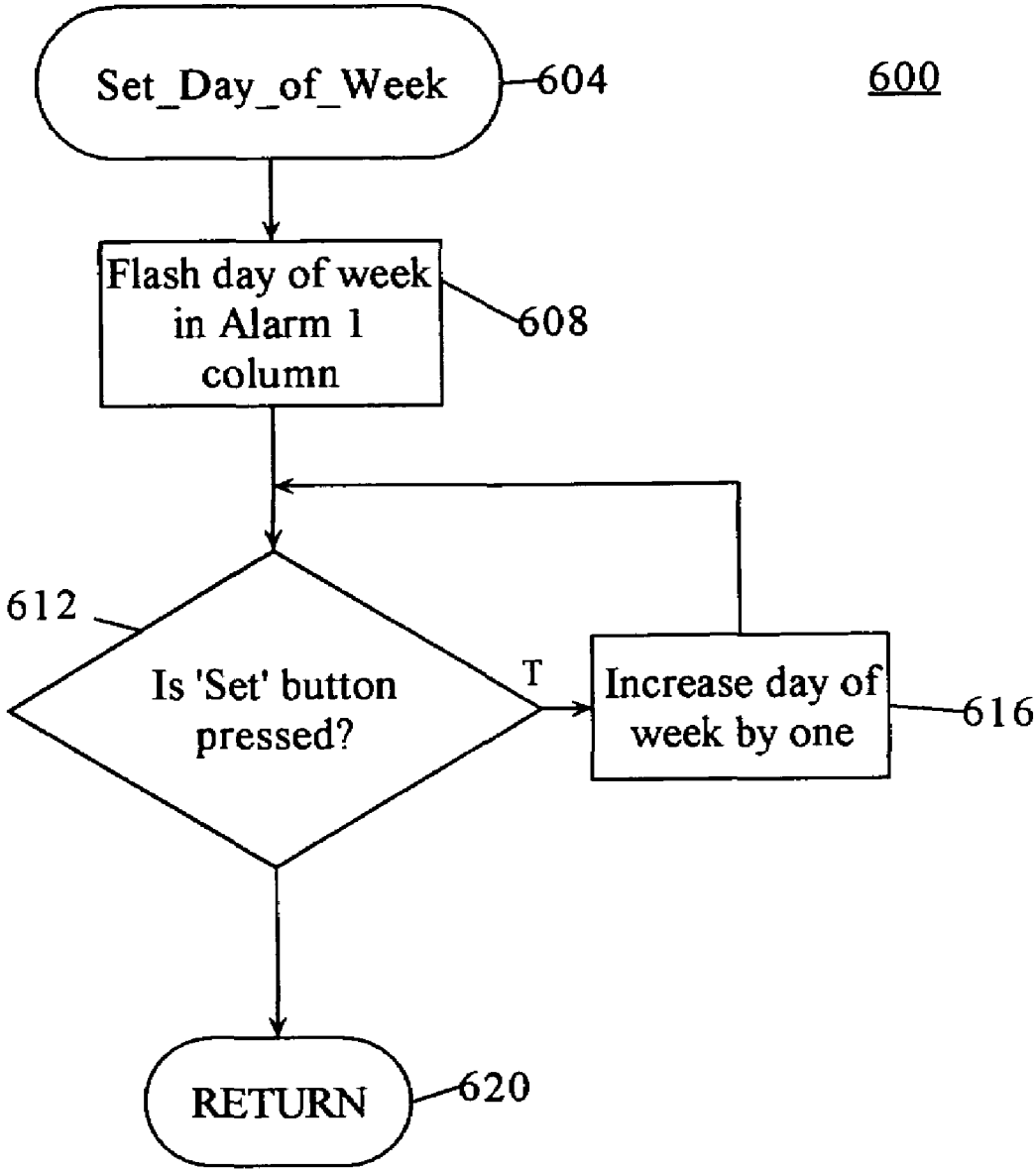

FIG. 7 Setting Alarms Main Procedure
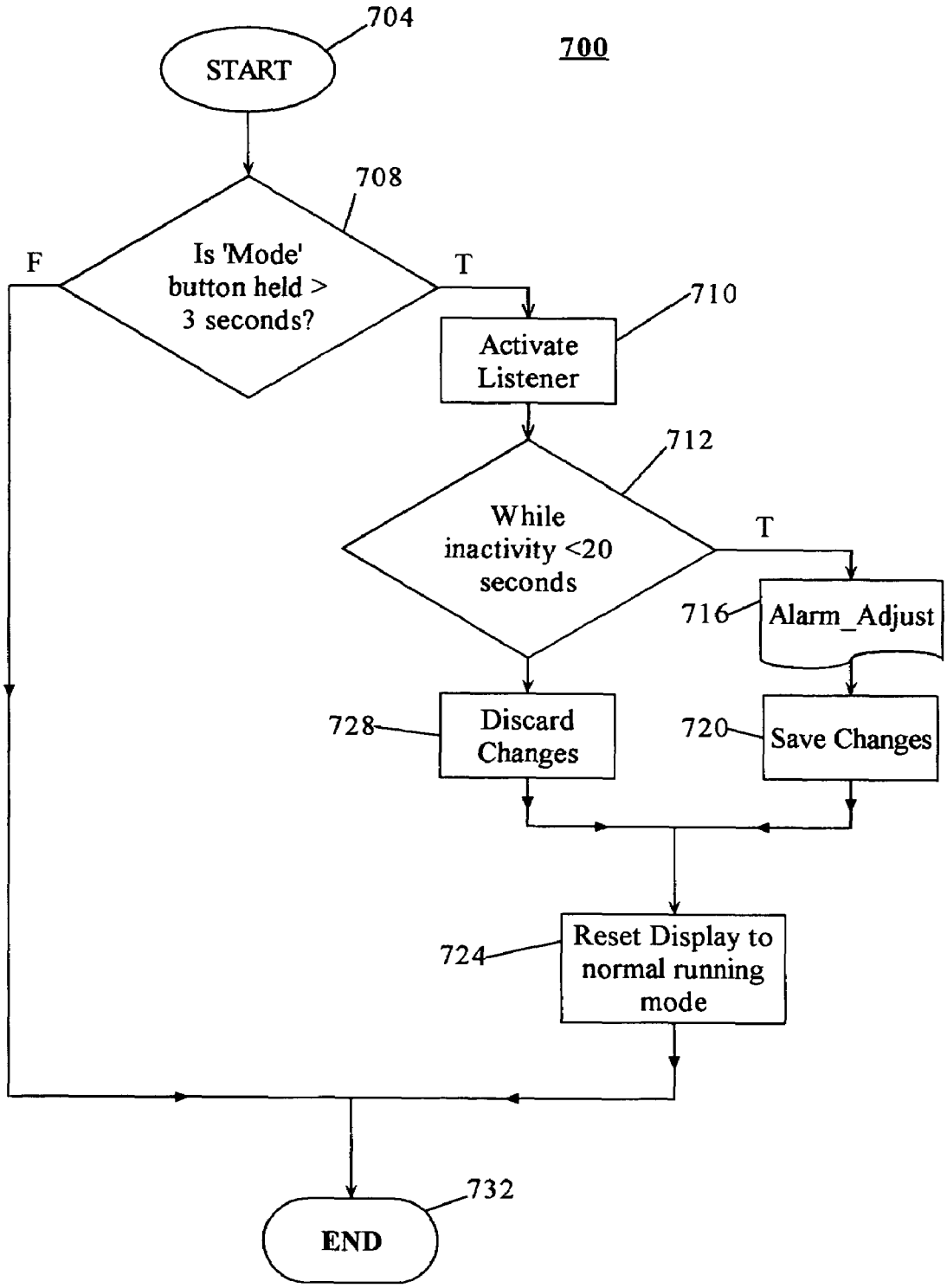

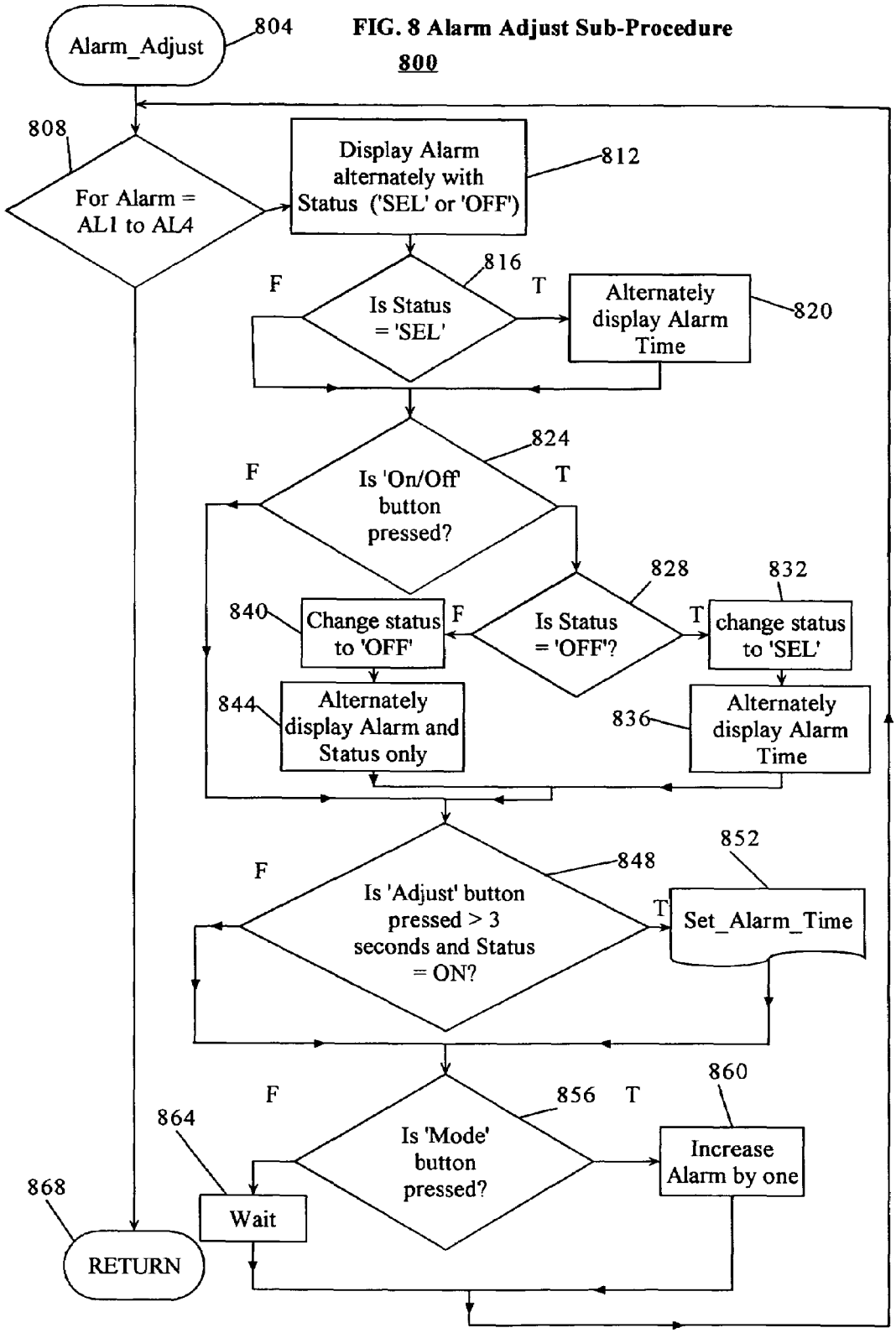
Alarm_Adjust
804
FIG. 8 Alarm Adjust Sub-Procedure
800
808
For Alarm = AL1 to AL4
Display Alarm alternately with Status ('SEL' or 'OFF')
812
816
F
T
Is Status = 'SEL'
Alternately display Alarm Time
820
824
F
T
Is 'On/Off' button pressed?
828
832
840
Change status to 'OFF'
F
Is Status = 'OFF'?
T
change status to 'SEL'
844
Alternately display Alarm and Status only
836
Alternately display Alarm Time
852
848
F
Is 'Adjust' button pressed > 3 seconds and Status = ON?
T
Set_Alarm_Time
860
F
856
T
864
Is 'Mode' button pressed?
Increase Alarm by one
868
Wait
RETURN FIG. 9 Setting Alarm Time Sub-Procedure
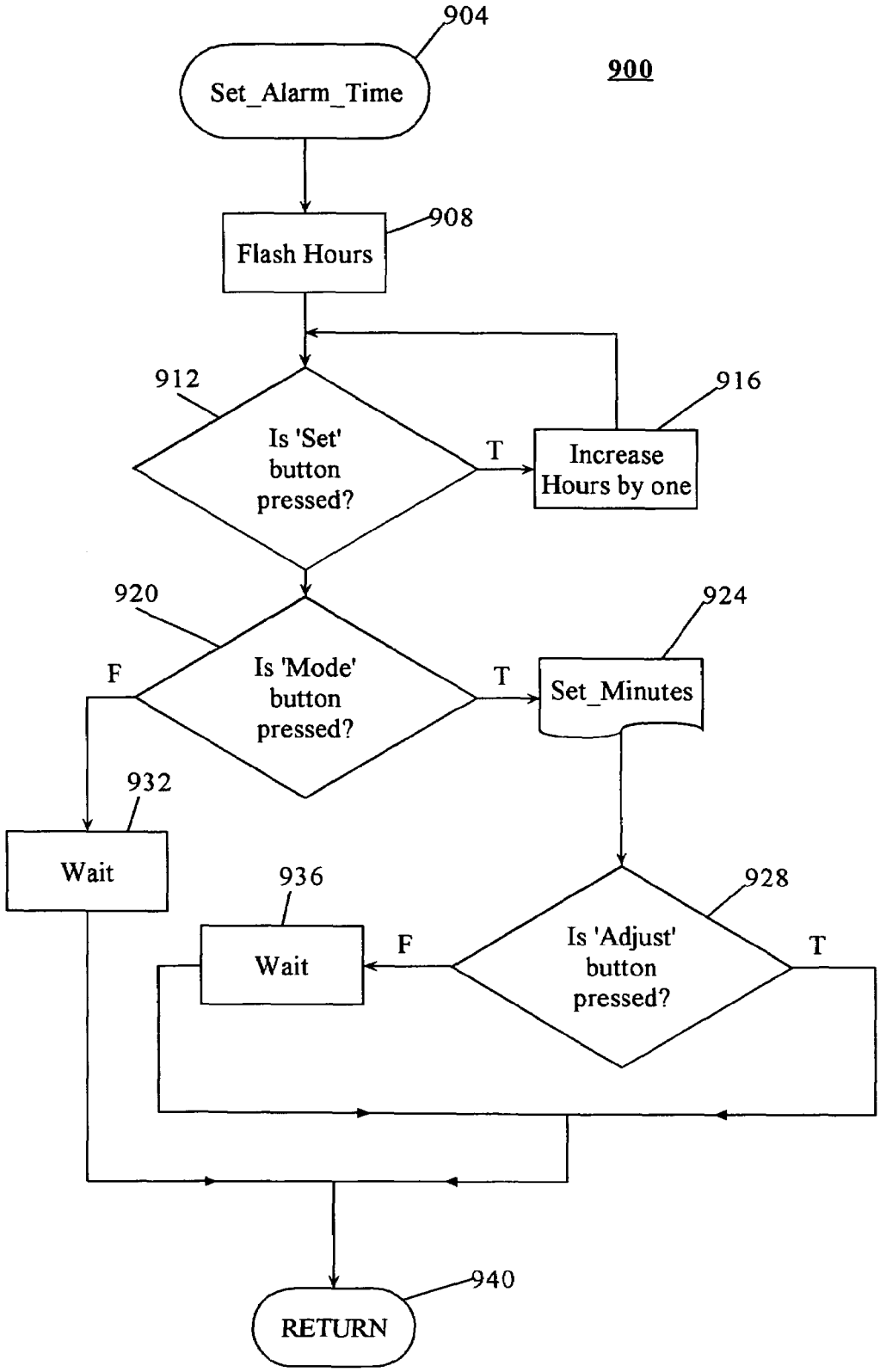

FIG. 10 Activating Alarm
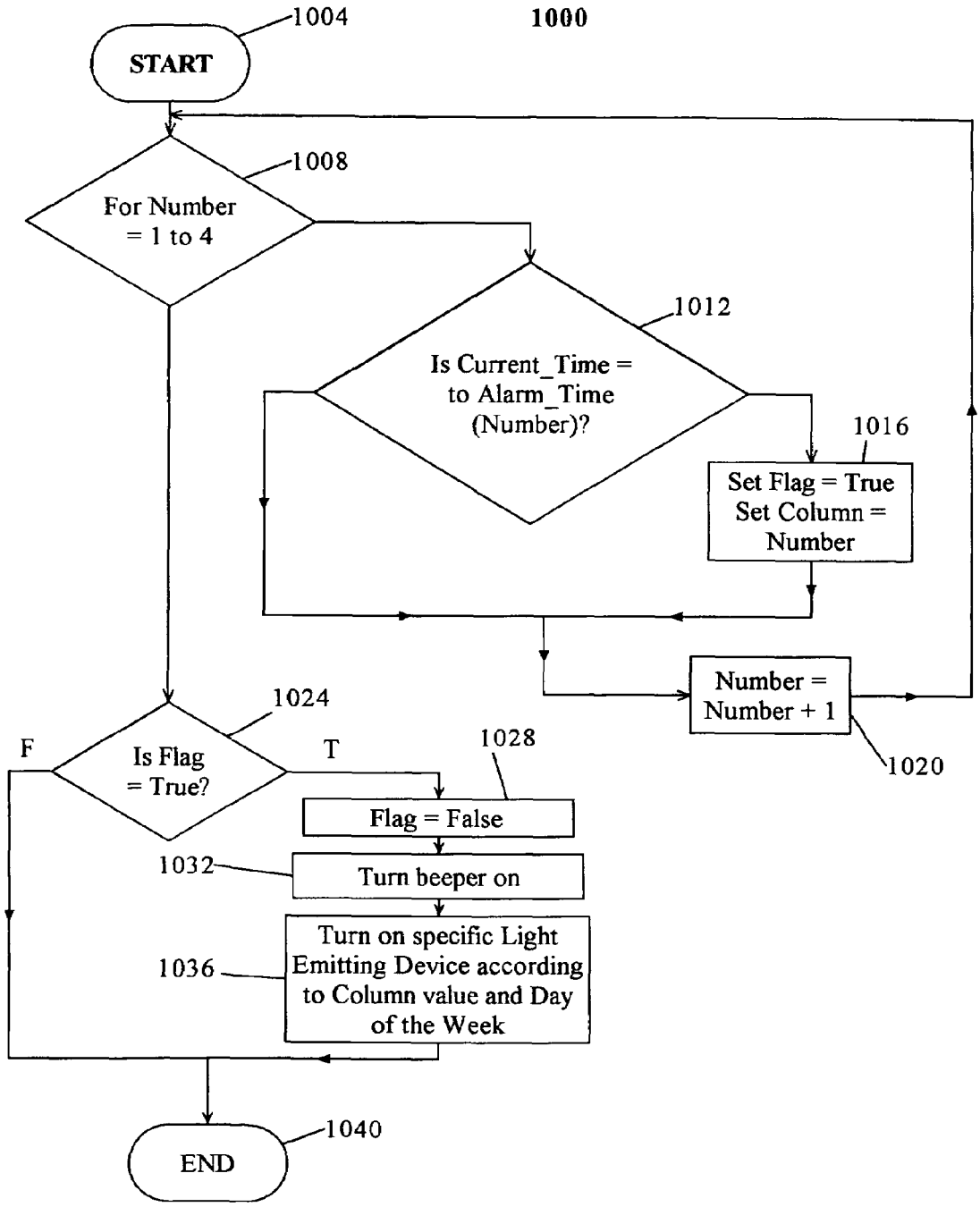

FIG. 11 Resetting Active Alarm
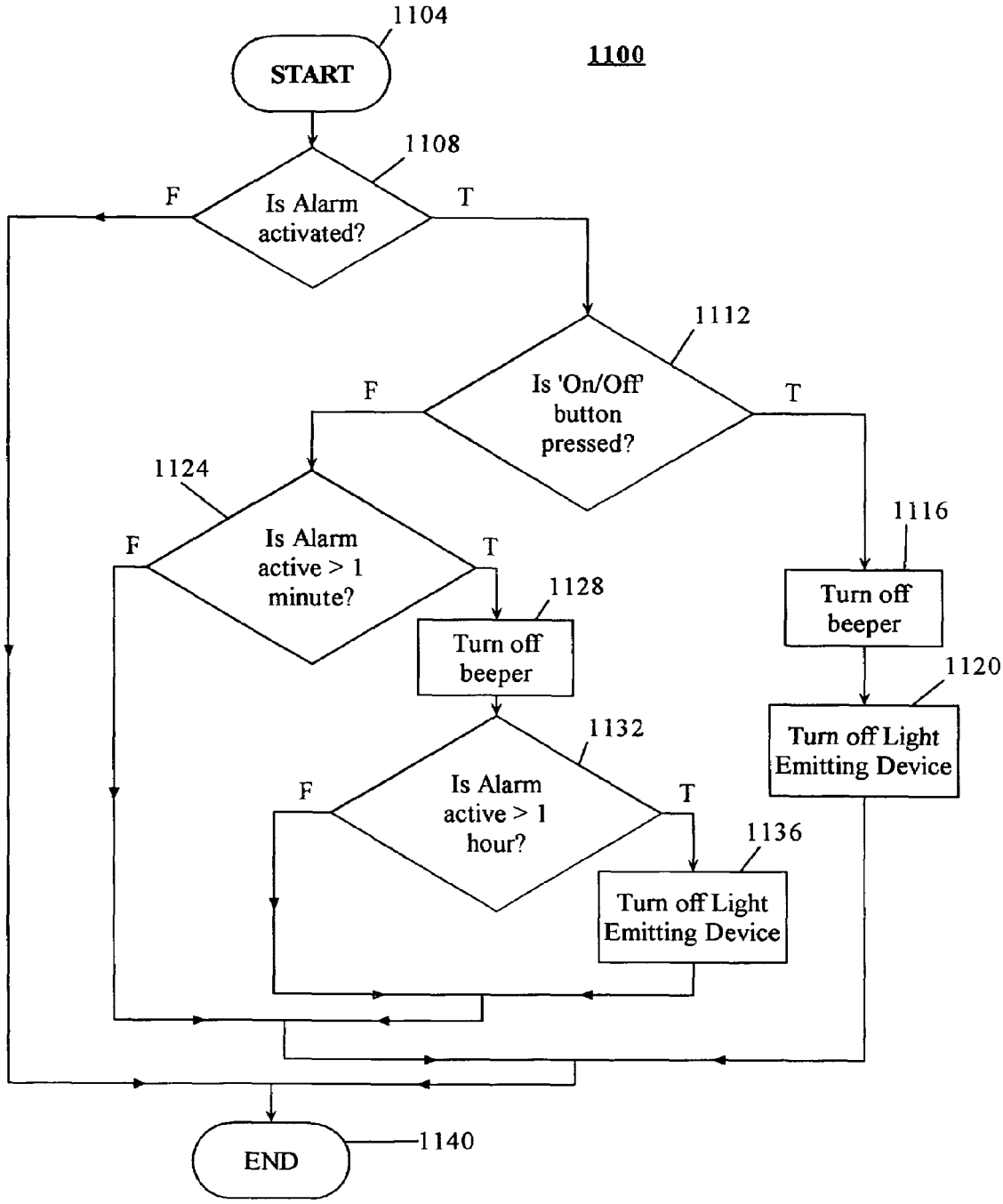

BLISTER PACK MEDICATION REMINDER SYSTEM AND METHOD

FIELD OF THE INVENTION

The present invention relates to medication dispensing reminder systems, in particular, reminder systems that work with medications dispensed in blister packs.

BACKGROUND OF THE INVENTION

Medications are often dispensed by pharmacies for patients in blister packs which are prepackaged cards of up to 28 blisters, typically in four column by seven row configuration. Each row represents a day a week whereas each column represents a time during the day "e.g. breakfast, lunch, supper, bedtime" when medication is to be taken. Accordingly, each blister pack represents a week's worth of medication for a patient. Each blister is, typically, a clear plastic bubble projecting from the blister pack. The pack will have a foil or paper backing whereby depressing the blister from the top will cause the medication to puncture through the rear foil or paper so that the medication is freed from the pack to be taken by the patient.

Some patients are forgetful, however, and will lose track of time and not take the appropriate medication at the appropriate time. It is, therefore, desirable to provide a blister pack medication reminder system to alert the patient to take their medication from the appropriate blister at the appropriate time of day.

SUMMARY OF THE INVENTION

The present invention is a medication reminder system and method for use with blister packs containing medications to be taken by a patient. The system includes a case, preferably made of plastic, large enough to enclose a blister pack. The case has top and bottom halves that are releasably connectable together. The top case half has openings, one for each blister on a blister pack to pass through when a blister pack is sandwiched between the top and bottom cases. The system further comprises a circuit board having a microprocessor, a memory, interaction means and alarm means. The circuit board also comprises openings for each blister on a blister pack to pass through and is designed to be placed on top of the blister pack when sandwiched between the top and bottom case halves. A battery cell mounted on the circuit board provides power to the electronics contained thereupon.

The memory contains a program code segment operatively connected to the microprocessor whereby the combination of the memory, the program code segment and the microprocessor is adapted to be programmed using the interaction means to set at least one alarm that will indicate when a predetermined blister is to be opened at a predetermined time. As a blister pack will contain up to 28 doses of medication to be taken over a one week period, the system can be programmed to provide up to four alarms a day to alert a patient to take those medications over the one week period. The present invention is programmable such that each of the four alarms can be turned on or off. The time for when each alarm is to be sounded can be programmed.

Interaction means are operatively connected to the microprocessor and consists of a display for providing messages to the patient. The interaction means also comprises a series of button-operated switch contacts used to provide input commands for setting the time of an internal clock and for programming the alarm times.

The alarm means comprises a speaker used for providing an audible alarm. The alarm means also comprises a light emitting device for each blister on the blister pack. In the preferred embodiment of the present invention, each light emitting device is a light emitting diode ("LED"). Each LED is placed on the circuit board near the blister it is associated with. When it is time to take medication, the LED near the blister to be opened will light visually indicating which blister needs to be opened. The alarm means are operatively connected to the microprocessor and controlled by the microprocessor.

To accommodate the interaction means and the alarm means, the top case comprises further openings to allow the display, the buttons and the LEDs to pass through when the system is assembled together so that they are accessible and visible to the patient.

The bottom case half is designed to have a plurality of openings, one opening positioned under each blister of the blister pack. These openings permit the removal of medication from the blister by depressing the blister from the top thereby causing the medication to puncture through the rear foil of the blister pack and fall through the opening.

When the blister pack has been depleted, the case can be opened to remove the used blister pack and insert a new blister pack. No alarms or settings need to be changed at this time unless the patient's medication regime has changed.

It is an object of the present invention to alert a patient when to take medication from a predetermined blister or a blister pack at a predetermined time.

Broadly stated, one aspect of the present invention is a blister pack medication reminder system, comprising a top case having a plurality of openings for allowing a plurality of blisters of a blister pack to pass through, each blister adapted to contain a dose of medication, a bottom case adapted to releasably connect to said top case, said top and bottom cases adapted to receive said blister pack therebetween, a circuit board adapted to be positioned between said top case and said blister pack when said top and bottom cases are releasably connected together, said circuit board comprising a microprocessor and a memory, said memory adapted to contain a program code segment to operate said microprocessor, interaction means for interacting with said reminder system, said interaction means mounted on top of said circuit board and operatively connected to said microprocessor, alarm means for producing an alarm when medication in a predetermined blister is to be taken at a predetermined time, said alarm means operatively connected to said microprocessor, a program code segment operatively contained in said memory, said program code having instructions adapted to operate said microprocessor, the combination of said program code segment, said memory and said microprocessor adapted to be programmed to produce at least one alarm at a predetermined time and to operate said alarm means when said at least one alarm is produced at said predetermined time, and power means for powering said circuit board.

Broadly stated, another aspect of the present invention is a method for reminding a user when to take medication from a blister in a blister pack, the method comprising the steps of providing a blister pack medication reminder system, said reminder system adapted to be programmed to provide an alarm indicating when the medication in a predetermined blister is to be taken by said user at a predetermined time, programming said reminder system to produce at least one alarm at a predetermined time, said at least one alarm indicating a predetermined blister of said blister pack to be opened in order to remove the medication contained therein, producing said at least one alarm at said predetermined time, providing an audible alarm when said at least one alarm is produced at said predetermined time, and visually identifying said predetermined blister when said at least one alarm is produced at said predetermined time.

BRIEF DESCRIPTION OF THE DRAWINGS

FIG. 3 is a flowchart describing the logic for setting the current time on the present invention.

FIG. 4 is a flowchart describing the sub-procedure logic used for setting the current time on the present invention.

FIG. 5 is a flowchart describing the sub-procedure logic used for setting the minutes for both the current time and alarm time on the present invention.

FIG. 6 is a flowchart describing the sub-procedure logic used for setting the day of the week for the current time on the present invention.

FIG. 7 is a flowchart describing the logic used for setting the alarms to on or off and setting the alarm time on the present invention.

FIG. 8 is a flowchart describing the sub-procedure logic used for setting each of the four alarms to on or off and setting the alarm time for each of the four alarms on the present invention.

FIG. 9 is a flowchart describing the sub-procedure logic used for setting the alarm time on the present invention.

FIG. 10 is a flowchart describing the logic used for the present invention to check the alarm times against the current time and activate the alarm if the condition is true.

FIG. 11 is a flowchart describing the logic used for resetting the alarm once the alarm has become activated on the present invention.

DETAILED DESCRIPTION OF THE PREFERRED EMBODIMENT

Figure 1:
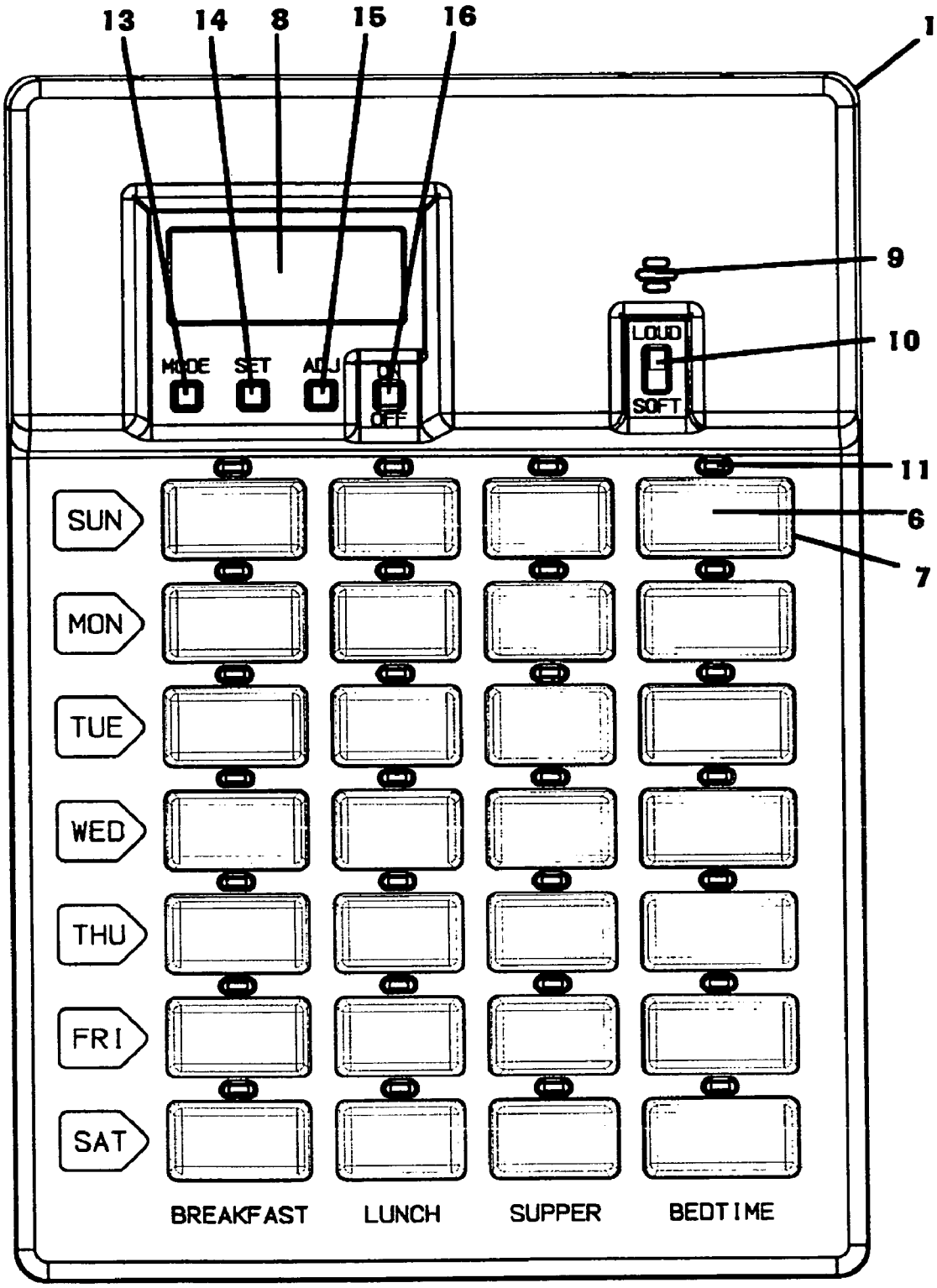
FIG. 1 is a top plan view of the present invention with a blister pack inserted.
Figure 2:
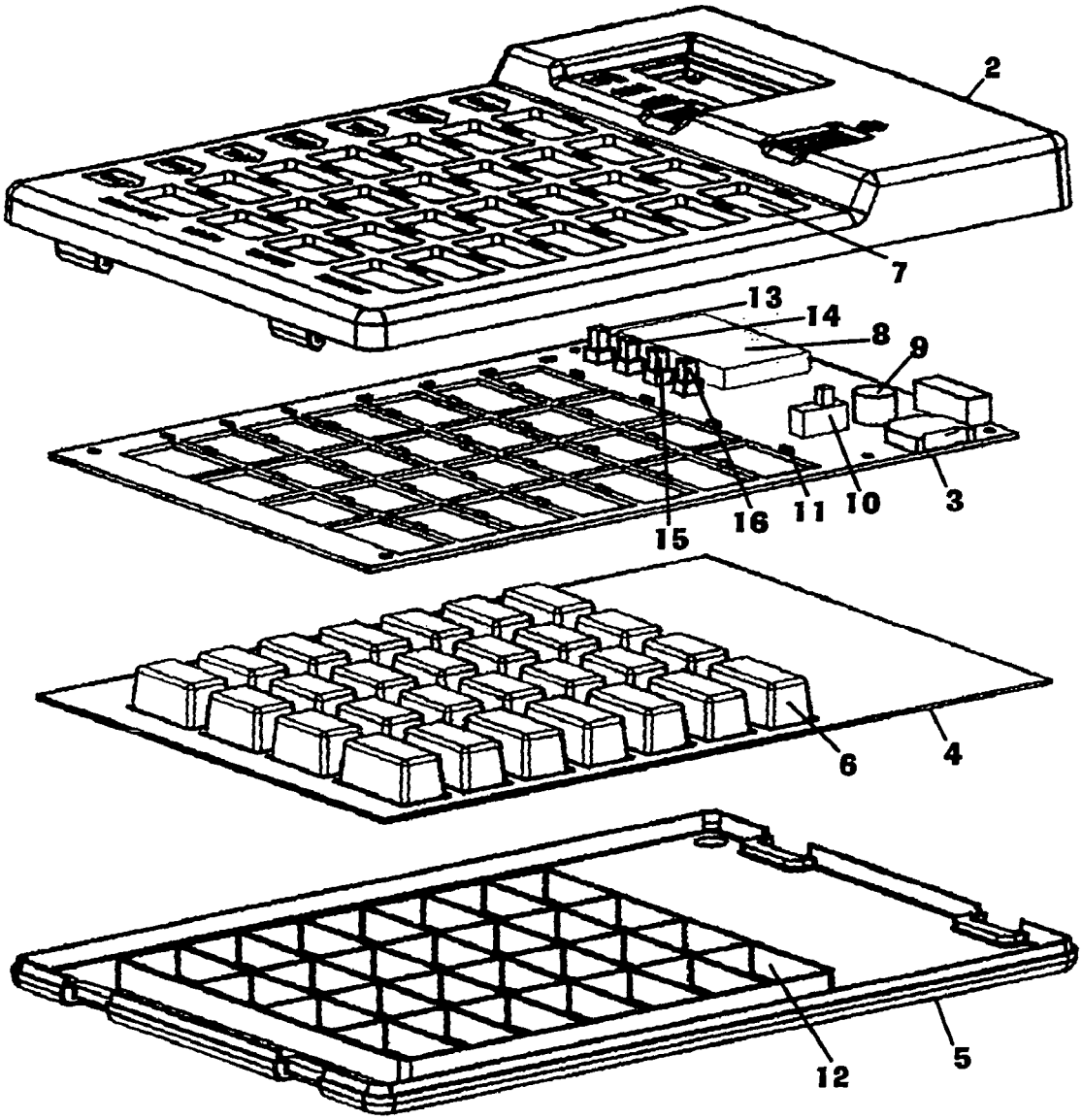
FIG. 2 is a perspective exploded view of the present invention showing the top case (2), the circuit board (3), a blister pack (4) and the bottom case (5).

Referring to FIGS. 1 and 2, Blister Pack Medication Reminder System (1) is comprised of top case (2), circuit board (3), blister pack (4), and bottom case (5). Blisters (6) of blister pack (4) will insert into spaces (7) of top case (2). Display (8) shows the current time and cues when programming. Speaker (9) has loud/soft switch (10) and beeps when the alarm time matches the current time when the system is in operational mode. Light Emitting Diodes (11) centered above each space (7) in system (1) which flash when the alarm time matches the current time to indicate which blister (6) is to be opened. Blister (6) is depressed causing the medication therein to pierce through the rear foil of blister pack (4) and fall through cavity (12) of bottom case (5) in order to retrieve the medication. Located below display (8) are the four buttons: Mode (13), Set (14), Adjust (15) and ON/OFF (16).

These buttons are used to set the current time, turn alarms on or off, set alarm times and to turn off an alarm when System (1) is in operation.

Setting Time

Referring to FIG. 3, the instructions to set the time are set out in Set_Time Main Program (300). The instructions are as follows:

a) Press and hold the "ADJUST" button (15) for a few second until the hours begin to flash.

b) Press "SET" button (14) until proper hour is flashing.

c) Press "MODE" button (13) to move to minutes.

d) Press "SET" button (14) until proper minute is flashing.

e) Press "MODE" button (13) to set the day of the week.

f) Press "SET" button (14) until proper day of week indicator is flashing.

g) Press "ADJUST" button (15) to end procedure.

If Adjust button (15) is pressed for more than 3 seconds (step 308), then a listener is activated (step 310). According to this listener, while no other buttons are pressed in a consecutive 20 second time frame (step 312), all attempted setting since the listener was activated will be cancelled (step 332) and display (8) will return to normal running mode showing the current time (step 336). Otherwise, the user will continue to the Set_Time sub-procedure (step 316). Once returning from the Set_Time sub-procedure and the user presses Adjust button (15) (step 320), the changes will be saved (step 324) and display (8) will show the new current time (step 328). However, should Adjust button (15) not be pressed within 20 seconds, all attempted settings will be cancelled (step 332) and display (8) will return to normal running mode showing the current time (step 336).

When the user is sent to the Set_Time Sub-Procedure (400), illustrated in FIG. 4, the Hours on display (8) will flash (step 408) indicating to the user that this setting can now be changed. For every press of Set button (14) (step 412), the hours will increase by one (step 416). Once the hours are set, the user must press Mode button (13) (step 420) to continue to Set_Minutes sub-procedure (step 424). Once the minutes are set, the user must press Mode button (13) (step 428) to continue to Set_Day_of_Week sub-procedure (step 432). Once the day of the week is set, the user will be returned to Setting Time Main Program (step 444). If the user does not press Mode button (13) (step 420) (step 428) within 20 seconds, all attempted settings will be cancelled (step 332) and display (8) will return to normal running mode showing the current time (step 336). Once the time is set, the user will be returned (step 444) to the Set Time Main Program (300).

When the user is sent to the Set_Minutes Sub-Procedure (500), illustrated in FIG. 5, the Minutes on display (8) will flash (508) indicating to the user that this setting can now be changed. For every press of Set button (14) (step 512), the minutes will increase by one (step 516). Once the minutes are set, the user will be retuned (step 520) to the Set Time Sub-Procedure (400).

When the user is sent to the Set_Day_of_Week Sub-Procedure (600), illustrated in FIG. 6, Light Emitting Diode (11) in first column on the day of week of the current setting will flash (step 608) indicating to the user that this setting can now be changed. For every press of Set button (14) (step 612), Light Emitting Diode (11) will flash on the row representing the next day of the week (step 616). Once the day of the week is set, the user will be returned (step 620) to the Set Time Sub-Procedure (400).

Setting Alarms

The procedure for setting alarms on System (1) are as follows:

a) Press and hold "MODE" button (13) until "AL 1" (Alarm 1) shows in display (8) alternately with status "SEL" (Select) or "OFF".
b) Press "ON/OFF" button (16) to turn alarm on or off.
c) Press "MODE" button (13) and repeat procedure for "AL 2" (Alarm 2), "AL 3" (Alarm 3) and "AL 4" (Alarm 4).
d) When "AL 4" (Alarm 4) is displayed, press the "MODE" button (13) to end the procedure.

During Setting Alarm Main Procedure (700), illustrated in FIG. 7, if Mode button (13) is pressed for more than 3 seconds (step 708), then a listener is activated (step 710). According to this listener, while no other buttons are pressed in a consecutive 20 second time frame (step 712), all attempted setting since the listener was activated will be cancelled (step 728) and display (8) will return to normal running mode showing the current time (step 724). Otherwise, the user will continue to Alarm_Adjust Sub-Procedure (step 716). When the user return from Alarm_Adjust Sub-Procedure 800, illustrated in FIG. 8, then the changes are saved (step 720), and display (8) will return to normal running mode showing the current time (step 724).

When the user is sent to Alarm_Adjust Sub-Procedure (800), for each of the alarms starting with Alarm 1 (AL1) (step 808), display (8) will show the current alarm being adjusted alternatively with its' status (SEL or OFF) (step 812). If the current alarm's status is SEL (ON) (step 816), then the alarm time will also be displayed alternately (step 820) with the value of the current alarm and its' status. If ON/OFF button (16) is pressed (step 824), then if the current alarm's status is OFF (step 828), it will change it to ON (step 832) and alternately display that alarms' time (step 836), else, it will change it to OFF and alternately display the Alarm number and Status only. If the user is just turning the alarms ON or OFF, then the user needs only to press Mode button (13) (step 856) and increase the alarm by one (step 860). If the Alarm number is no longer in the range from Alarm 1 to Alarm 4 (step 808), then the user is returned (step 868) to Setting Alarms Main Procedure (700).

Setting Alarm Times

Setting the alarm times on System (1) is accomplished as follows:

a) Press "MODE" button (13) until "AL 1" (Alarm 1) shows in display (8) alternately with status "SEL" (Select) or "OFF".
b) Alarm must be in "SEL" (Select) mode to set the alarm time.
c) Press the ON/OFF button (16) to change display (8) to "SEL" (Select) if needed.
d) Press and hold the "ADJUST" button (15) for a few seconds until the hours begin to flash.
e) Press "SET" button (14) until proper hour is flashing.
f) Press "MODE" button (13) to move minutes.
g) Press "SET" button (14) until proper minute is flashing.
h) Press "ADJUST" button (15) when proper time is selected.
i) Repeat process for alarms "AL 2" (Alarm 2). "AL 3" (Alarm 3) and "AL 4" (Alarm 4) as needed.

When setting the Alarm time, if Mode button (13) is pressed for more than 3 seconds (step 708), then a listener is activated (step 710). According to this listener, while no other buttons are pressed in a consecutive 20 second time frame (step 712), all attempted settings since the listener was activated will be cancelled (step 728) and display (8) will return to normal running mode showing the current time (step 724). Otherwise, the user will continue to the Alarm_Adjust Sub-Procedure (step 716). When the user returns from the Alarm_Adjust Sub-Procedure (800), then the changes are saved (step 720), and display (8) will return to normal running mode showing the current time (step 724).

When the user is sent to the Alarm_Adjust Sub-Procedure (800), for each of the alarms starting with Alarm 1 (AL1) (step 808), display (8) will show the current alarm being adjusted alternately with its' status (SEL or OFF) (step 812). If the current alarm's status is SEL (ON) (step 816), then the alarm time will also be displayed alternately (step 820) with the value of the current alarm and its' status. If ON/OFF button (16) is pressed (step 824), then if the current alarm's status is OFF (step 828), it will change it to ON (step 832) and alternately display that alarms' time (step 836), else, it will change it to OFF and alternately display the Alarm number and Status only. If the Adjust button is pressed for more than 3 seconds, and the Status is equal to ON (step 848), then the user will go through the steps outlined in the Set_Alarm_Time sub-procedure (step 852). If Mode button (13) (step 856) is pressed, then the alarm is increased by one (step 860). If the Alarm number is no longer in the range from Alarm 1 to Alarm 4 (step 808), then the user is returned (step 868) to the setting Alarms Main Procedure (700).

When the user is sent to the Set_Alarm_Time Sub-Procedure (900), illustrated in FIG. 9, the Hours on display (8) will flash (step 908) indicating to the user that this setting can now be changed. For every press of Set button (14) (step 912), the hours will increase by one (step 916). Once the hours are set, the user must press Mode button (13) (step 920) to continue to the Set_Minutes sub-procedure (step 924). Once the minutes are set, and the user presses Adjust button (15) (step 928), the user will be returned (step 940) to the Alarm Adjust Sub-Procedure (800).

Every minute, the system will check if the current time is equal to an alarm time and activate the alarm accordingly as illustrated in FIG. 10. A variable called Number is assigned a numeric value from 1 to 4 (step 1008). It will then use this number to check if the current time is equal to one of the 4 alarm times. If an alarm time equals the current time (step 1012), then a flag is set to True and the column value is set to the value of the variable Number (1, 2, 3 or 4) (step 1016). The variable Number is then increased by one (step 1020). Once the variable Number is greater than 4 (step 1008) then the Flag is checked (step 1024). If the flag is True (step 1024), then the flag is reset to False (step 1028), the audible alarm is turned on (step 1032) and Light Emitting Diode (11) at the intersection of the column and the day of the week is set to flash (step 1036).

Resetting Alarm when System is in Operational Mode

To reset the alarm when System 1 is in operational mode, ON/OFF button (16) is pressed to turn alarm off.

Once an alarm is activated, the user will be able to deactivate the alarm, or over a period of time, the alarm will sequentially deactivate itself as illustrated in FIG. 11. If the alarm is activated (step 1108), then if the user the presses ON/OFF button (16) (step 1112), audible alarm (9) and Light Emitting Diode (11) are turned off (step 1116) (step 1120). If ON/OFF button (16) is not pressed (step 1112), then after one minute of the alarm being active (step 1124), audible alarm (9) will be turned off by the system (step 1128). If after an hour of the alarm being active (step 1132), then the Light Emitting Diode (11) will be turned off by the system (step 1136).

The rows of spaces (7) reflect the days of the week, (Sunday through Saturday), and the columns of spaces (7) reflect the time of day, (breakfast, lunch, supper, and bedtime). The software program containing the logistics will determine which Light Emitting Diode (11) at the intersection of the row and column will be emitted at the specified alarm time indication which blister is to be expressed into cavities (12) of the bottom case.

Although a few preferred embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized at the scope of the invention as defined and limited only by the claims that follow.

I claim:

1. A blister pack medication reminder system, comprising:

a) a top case having a plurality of openings for allowing a plurality of blisters of a blister pack to pass through, each blister adapted to contain a dose of medication;

b) a bottom case adapted to releasably connect to said top case, said top and bottom cases adapted to receive said blister pack therebetween;

c) a circuit board adapted to be positioned between said top case and said blister pack when said top and bottom cases are releasably connected together, said circuit board comprising a microprocessor and a memory, said memory adapted to contain a program code segment to operate said microprocessor;

d) interaction means for interacting with said reminder system, said interaction means mounted on top of said circuit board and operatively connected to said microprocessor;

e) alarm means for producing an alarm when medication in a predetermined blister is to be taken at a predetermined time, said alarm means operatively connected to said microprocessor;

f) a program code segment operatively contained in said memory, said program code having instructions adapted to operate said microprocessor, the combination of said program code segment, said memory and said microprocessor adapted to be programmed to produce at least one alarm at a predetermined time and to operate said alarm means when said at least one alarm is produced at said predetermined time; and g) power means for powering said circuit board.

2. The reminder system as set forth in claim 1 wherein said circuit board comprises an opening for each blister of said blister pack whereupon each blister will pass through said openings in said circuit board to be accessible by said user through the openings in said top case when said top and bottom cases are releasably connected together with said circuit board and said blister pack sandwiched therebetween.

3. The reminder system as set forth in claim 1 wherein said top case further comprises a plurality of openings for said interaction means and said alarm means to be accessible by a user when said top case and said bottom case are releasably connected together with said circuit board and said blister pack sandwiched therebetween.

4. The reminder system as set forth in claim 3 wherein said interaction means comprises:

a) a display for displaying messages to the user; and b) at least one button-operated switch contact for programming said combination of said program code segment, said memory and said microprocessor.

5. The reminder system as set forth in claim 4 wherein said interaction means comprises four button-operated switch contacts for programming said combination of said program code segment, said memory and said microprocessor.

6. The reminder system as set forth in claim 3 wherein said alarm means comprises:

a) a speaker for providing an audible indication of said alarm; and b) visual indication means for visually identifying which blister on said blister pack is to be opened when said alarm is produced.

7. The reminder system as set forth in claim 6 wherein said visual indication means comprises a light emitting device for each blister of said blister pack, each of said devices passing through an associated opening in said top case when said top and bottom cases are releasably connected together with said circuit board and said blister pack sandwiched therebetween.

8. The reminder system as set forth in claim 7 wherein said light emitting devices are light emitting diodes.

9. The reminder system as set forth in claim 2 wherein said bottom case further comprises a plurality of openings, an opening for each of said blisters of said blister pack, each opening located directly under a blister when said top and bottom cases are releasably connected together with said circuit board and said blister pack sandwiched therebetween, whereby the act of depressing a blister from the top forces the medication contained in said blister to puncture through the rear foil of said blister pack and fall through the bottom case opening located beneath said blister.

10. The reminder system as set forth in claim 1 wherein said power means comprises a battery cell operatively attached to said circuit board.

11. A method for reminding a user when to take medication from a blister in a blister pack, the method comprising the steps of:

a) providing a blister pack medication reminder system, said reminder system adapted to be programmed to provide an alarm indicating when the medication in a predetermined blister is to be taken by said user at a predetermined time;

b) programming said reminder system to produce at least one alarm at a predetermined time, said at least one alarm indicating a predetermined blister of said blister pack to be opened in order to remove the medication contained therein;

c) producing said at least one alarm at said predetermined time;

d) providing an audible alarm when said at least one alarm is produced at said predetermined time; and e) visually identifying said predetermined blister when said at least one alarm is produced at said predetermined time.

12. The method as set forth in claim 11 wherein said reminder system comprises:

a) a top case having a plurality of openings for allowing a plurality of blisters of a blister pack to pass through, each blister adapted to contain a dose of medication;

b) a bottom case adapted to releasably connect to said top case, said top and bottom cases adapted to receive said blister pack therebetween;

c) a circuit board adapted to be positioned between said top case and said blister pack when said top and bottom cases are releasably connected together, said circuit board comprising a microprocessor and a memory, said memory adapted to contain a program code segment to operate said microprocessor;

d) interaction means for interacting with said reminder system, said interaction means mounted on top of said circuit board and operatively connected to said microprocessor;

e) alarm means for producing an alarm when medication in a predetermined blister is to be taken at a predetermined time, said alarm means operatively connected to said microprocessor;

f) a program code segment operatively contained in said memory, said program code having instructions adapted to operate said microprocessor, the combination of said program code segment, said memory and said microprocessor adapted to be programmed to produce at least one alarm at a predetermined time and to operate said alarm means when said at least one alarm is produced at said predetermined time; and g) power means for powering said circuit board.

* * * * *